United States Patent [19]

Buers

[11] Patent Number: 5,072,343

[45] Date of Patent: Dec. 10, 1991

[54] ILLUMINATED RACK ASSEMBLY, IN PARTICULAR A DISPLAY CASE

[76] Inventor: Friedhelm Buers, Graf-Spee-Strasse 13, 4300 Essen-Bredeney, Fed. Rep. of Germany

[21] Appl. No.: 661,990

[22] Filed: Feb. 26, 1991

[30] Foreign Application Priority Data

Feb. 26, 1990 [DE] Fed. Rep. of Germany ..... 4006004

[51] Int. Cl.[5] ..... A47F 11/10

[52] U.S. Cl. ..... 362/125; 362/217; 362/249; 312/223

[58] Field of Search ..... 362/125, 133, 127, 217, 362/226, 227, 249, 250; 312/223

[56] References Cited

U.S. PATENT DOCUMENTS 2,694,137 11/1954 Williams ..... 362/125

4,845,601 7/1989 Podbury et al. ..... 362/125

4,979,078 12/1990 Amstutz et al. ..... 362/125

*Primary Examiner*—Ira S. Lazarus

*Assistant Examiner*—Richard R. Cole

*Attorney, Agent, or Firm*—Herbert Dubno; Andrew Wilford

[57] ABSTRACT

A rack assembly has a plurality of elongated rails of generally square section having four sides meeting at corners and each formed unitarily with a light groove opening at one of the corners between two adjacent sides, a supply groove opening at the corner between the other two sides diagonally opposite the light groove, and a pair of connecting grooves formed in and opening at the sides flanking one of the light and supply grooves. The connecting grooves open perpendicular to each other. At least one electrical conductor is exposed generally the full length of and extends along the supply groove and a tubular lamp extends along in the light groove. An accent lamp secured to the rail over the supply groove is connected to the conductor therein. Respective transverse elements are fitted to the connecting grooves.

13 Claims, 9 Drawing Sheets

ILLUMINATED RACK ASSEMBLY, IN PARTICULAR A DISPLAY CASE

FIELD OF THE INVENTION

The present invention relates to an illuminated rack assembly. More particularly this invention concerns such a rack assembly usable as a display case, vitrine, column cladding, or wall.

BACKGROUND OF THE INVENTION

A typical rack assembly, for instance used as a display rack, comprises upright posts to which are secured platforms or shelves that are used to support merchandise, art objects, or the like to be viewed. For best effect the items held by the rack should be illuminated, so some sort of accent lighting is provided European patent document 126,023 and Swiss patent 664,997 describe an arrangement wherein conductors are built in to at least one of the rails so that these conductors can be tapped to power lamps at any location along the rail.

At best such arrangements are difficult to set up and difficult to adapt to different requirements. Once provided with lamps, even where the supply lines can be hidden, it is usually impossible to change the lighting at one level without having to redo the entire assembly. Another disadvantage is that any unlighted level is normally left unhighlighted or so dark that it is not noticed at all.

OBJECTS OF THE INVENTION

It is therefore an object of the present invention to provide an improved illuminated rack assembly.

Another object is the provision of such an improved illuminated rack assembly which overcomes the above-given disadvantages, that is which can be set up to meet virtually any lighting scheme and that ca readily be altered to change the lighting scheme.

A further object is the provision of such an illuminated rack assembly which can also be used as a column or wall cladding.

SUMMARY OF THE INVENTION

A rack assembly according to this invention has a plurality of elongated rails of generally square section having four sides meeting at corners and each formed unitarily with a light groove opening at one of the corners between two adjacent sides, a supply groove opening at the corner between the other two sides diagonally opposite the light groove, and a pair of connecting grooves formed in and opening at the sides flanking one of the light and supply grooves. The connecting grooves open perpendicular to each other. At least one electrical conductor is exposed generally the full length of and extends along the supply groove and a tubular lamp extends along in the light groove. An accent lamp secured to the rail over the supply groove is connected to the conductor therein. Respective transverse elements are fitted to the connecting grooves.

Thus with this system it is possible to provide accent lights connected to the conductor or conductors in the supply groove. At the same time the fluorescent lamp tube in the light groove can provide some degree of illumination while outlining the rack assembly in an extremely eye-catching and attractive manner.

According to this invention a lens cover the light groove and the transverse elements are shelves including a top shelf and a bottom shelf vertically flanking and holding the lens. The lens is of an at least semitransparent synthetic resin and is snap fitted to the light groove. It may in turn be covered by a second outer lens. A compressible bumper strip in the light groove is braced between the tubular lamp and the rail.

The accent lamp is provided with mounting bolts engaged in the two other sides of the rail to each side of the supply groove. The rail is formed with lips projecting toward each other and bounding the supply groove and the conductor includes a pair of wires and a profiled resilient strip in which the wires are imbedded adjacent each other. This strip is formed with ribs braced outward against the lips to retain the wires in the supply groove.

The connecting grooves can be formed in the sides flanking the light groove in which case the light tube is on the inside of the corner formed at the rail or the connecting grooves can be formed in the sides flanking the supply groove in which it on the outside of the corner formed by the rail.

The rail according to the invention is further formed with at least one longitudinally throughgoing bolt passage and the assembly has a retaining bolt engaged in the passage and holding the transverse elements.

In accordance with an embodiment of the invention whereby the rack assembly is not used as a display case, but is used as a column or wall cladding, the transverse element is a panel and an edge strip engaged in the connecting groove. The edge strip is generally of H-section and has one leg engaged with the respective connecting groove and an opposite leg connected to the panel. This opposite leg has a perpendicular flange to which the panel is bolted and the panel is provided with spacer bolts adapted to engage a surface supporting the assembly.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
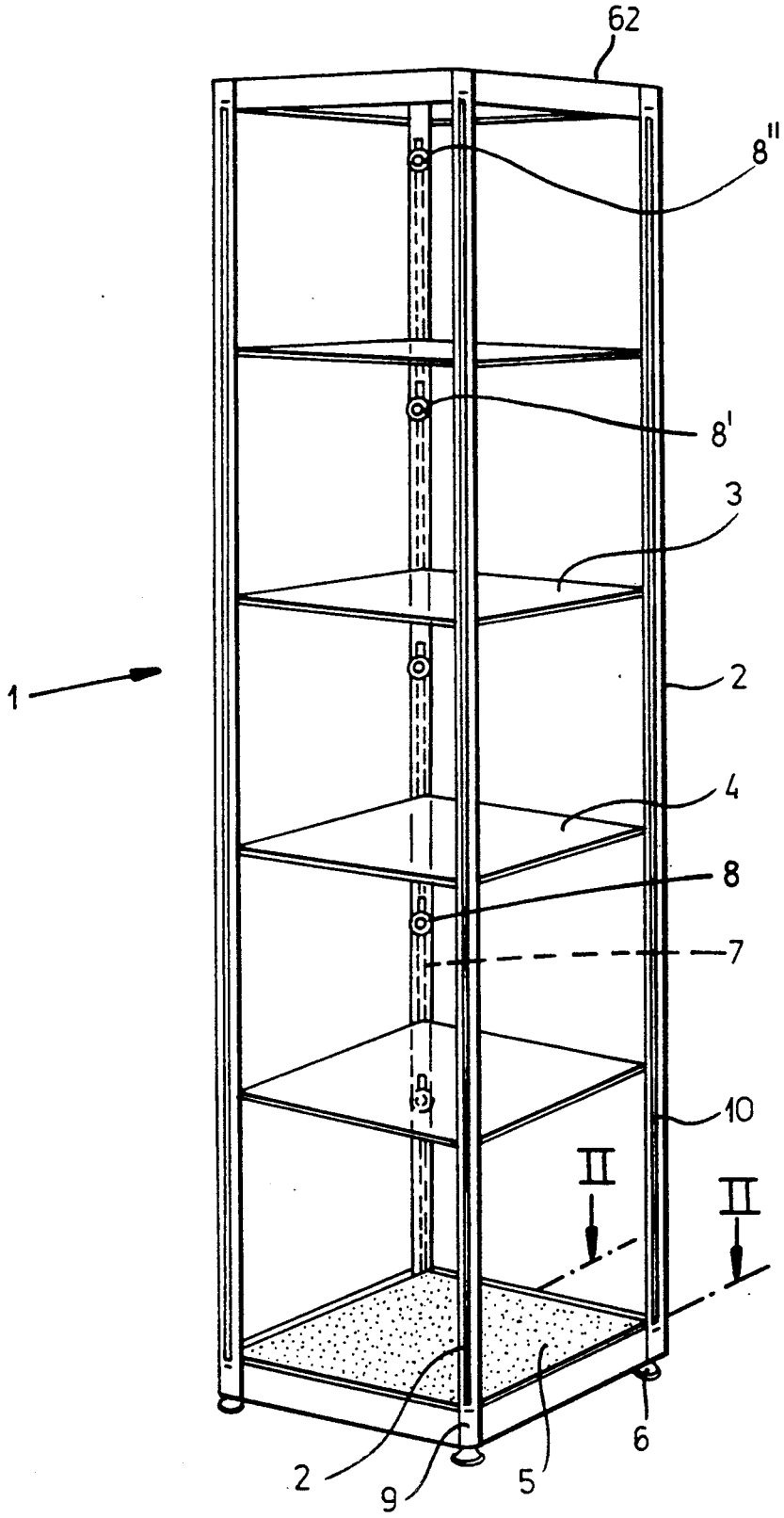
FIG. 1 is a perspective view of display case according to this invention.

As seen in FIG. 1 a display case or vitrine 1 according to the invention comprises four identical extruded profiled posts 2 bridged by intermediate shelves 3 and 4, a lowermost or floor shelf 5, and a top shelf or roof 62.

The rails 2 are vertical and lie on corners of the square horizontal shelves 3 and 4 and have lower ends provided with screw-in leveling feet 6. The outside surfaces 9 of the rails 2 are provided with recessed lamp bulbs 10 and the inner surfaces 22 can be fitted with individual spot or accent lamps 8, 8', and 8", typically halogen fixtures, fed from a recessed electrical supply line 7.

Figure 2:
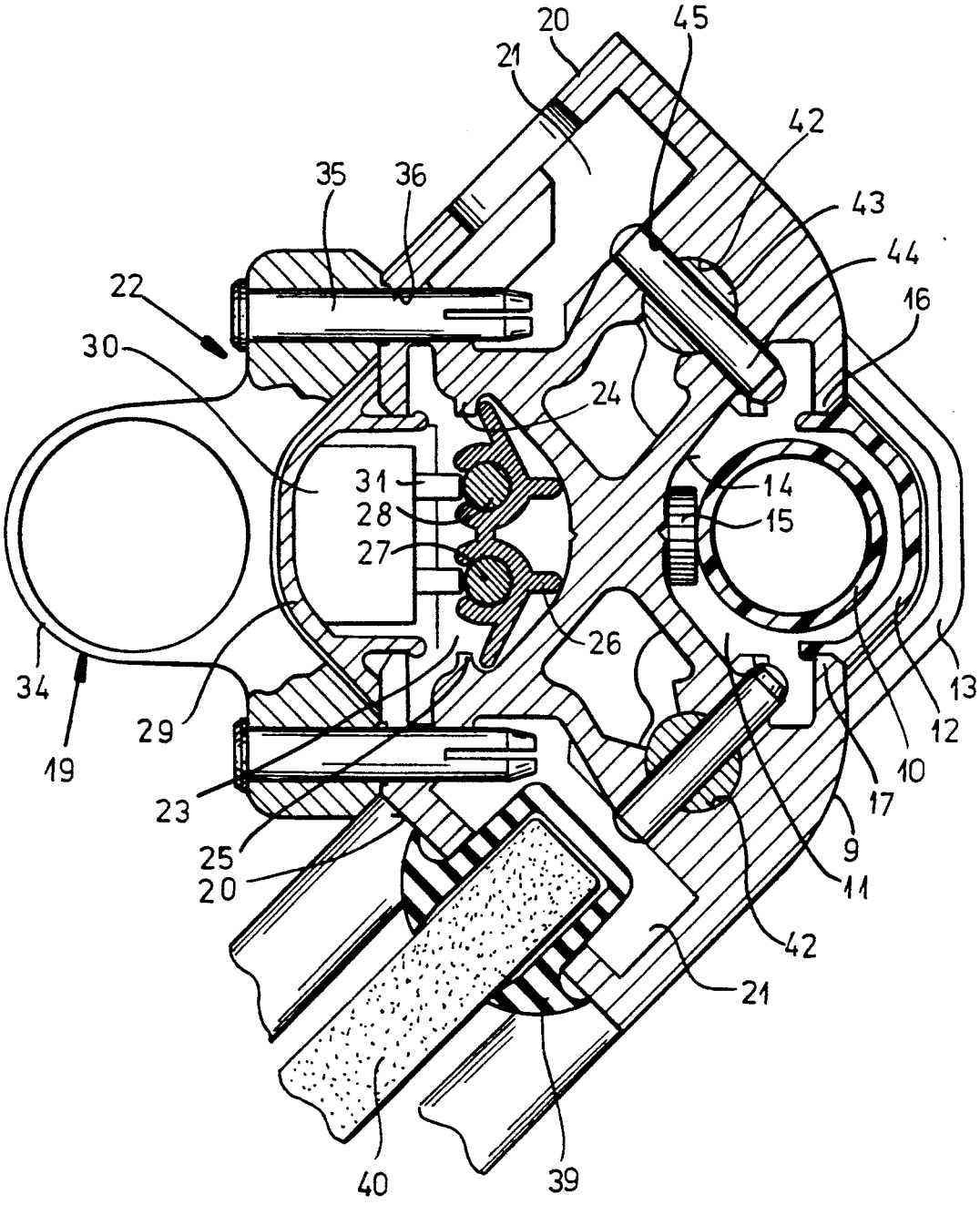
FIG. 2 is a section through one of the post rails taken along line II—II of FIG. 1.

FIG. 2 shows how the rail outer surface 9 is formed along its full length with an outwardly open groove or channel 11 defined between lips or edges 16 and 17 and housing the bulb 10. An elastic strip 15 is braced between a floor 14 of the groove or channel 11 and the bulb 10 to prevent it from rattling and to support it when, as is possible, the rail 2 is horizontal. A full-length U-section translucent inner lens 12 is snap fitted to the lips 16 and 17 and another at least semitransparent U-shaped lens strip 13 of plastic is secured over top of it to the outer face 9 of the rail 2.

This rail 2 is formed along its inside surface 22 with an oppositely open groove or channel 23 in which is housed the electrical line 7, here constituted by two copper conductors 27 and 28 in a insulating synthetic-resin extrusion 26 having ribs 26' and 26" (See FIG. 10) that snap behind lips 24 and 25 that bound the channel 23. These conductors 27 and 28 are exposed along their full lengths along thin strips toward the inside of the rail 2.

Normally snap-in aluminum covers 29 fit to the channel or groove 23 and cover and protect the line 7, serving both a decorative and safety function. These covers 29 are provided with knockouts, however so that fittings 19 can be mounted on the inside rail surface 22. The fittings 19 each have a plug 30 that can engage through the cover 29 and that has terminals or prongs 31 that are spring-loaded to press against the conductors 27 and 28. The fitting 19 has a socket 34 into which a halogen bulb is fitted to provide accent or spot lighting. Spread-type spring bolts 35 engaged through the fitting 19 and into holes 36 formed on the inside surface 22 of the rail 2 not only hold the fitting 19 in place, but also secure the covers 29 that are straddled by the fitting 19 in place.

The edges 20 of the rail 2 extend at right angles to each other and are formed with respective channels 21. In the embodiment of FIG. 2 a glass panel 40 has its edge fitted in a gasket 39 in turn fitted in one of the grooves 21. Of course, other panels or structure could be fitted to the grooves 21.

Immediately inward of each groove 21 the rail 2 is formed with a longitudinally throughgoing bolt-anchor passage 42 adapted to receive a bolt or pin 43 that is held in place by a crosspin 44 fitting through a crosswise passage 45 accessible via the respective groove 21 level with the uppermost shelf 62 and lowermost shelf 5. Such a bolt 43 can be also be used to secure in place the floor panel 5 or top panel 62. The use of a crosspin 44 eliminates the need to make the bolt 43 very long to go all the way through the rail 2.

Figure 3:
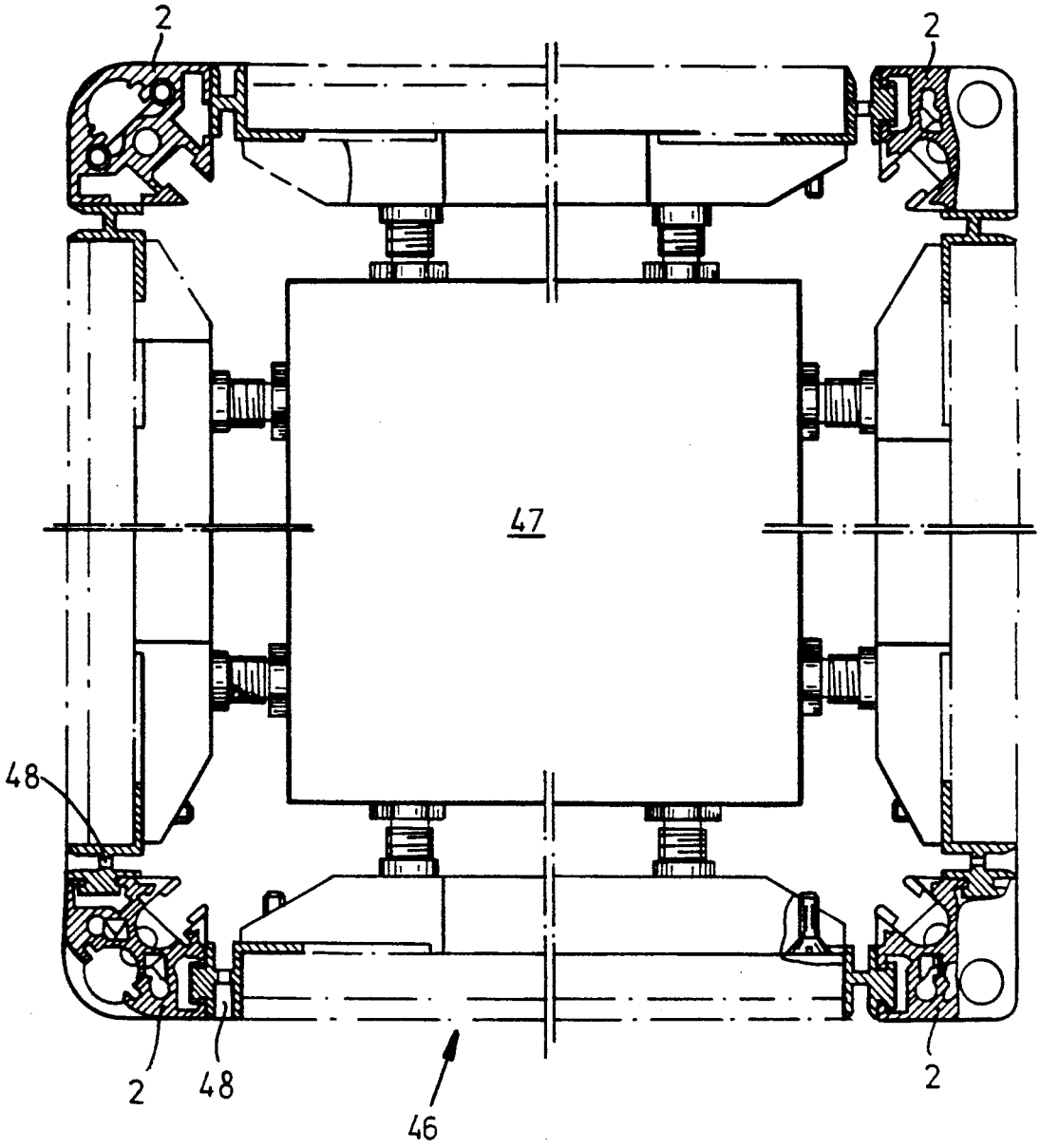
FIG. 3 is a horizontal section through the rack of this invention used to clad a column.
Figure 4:
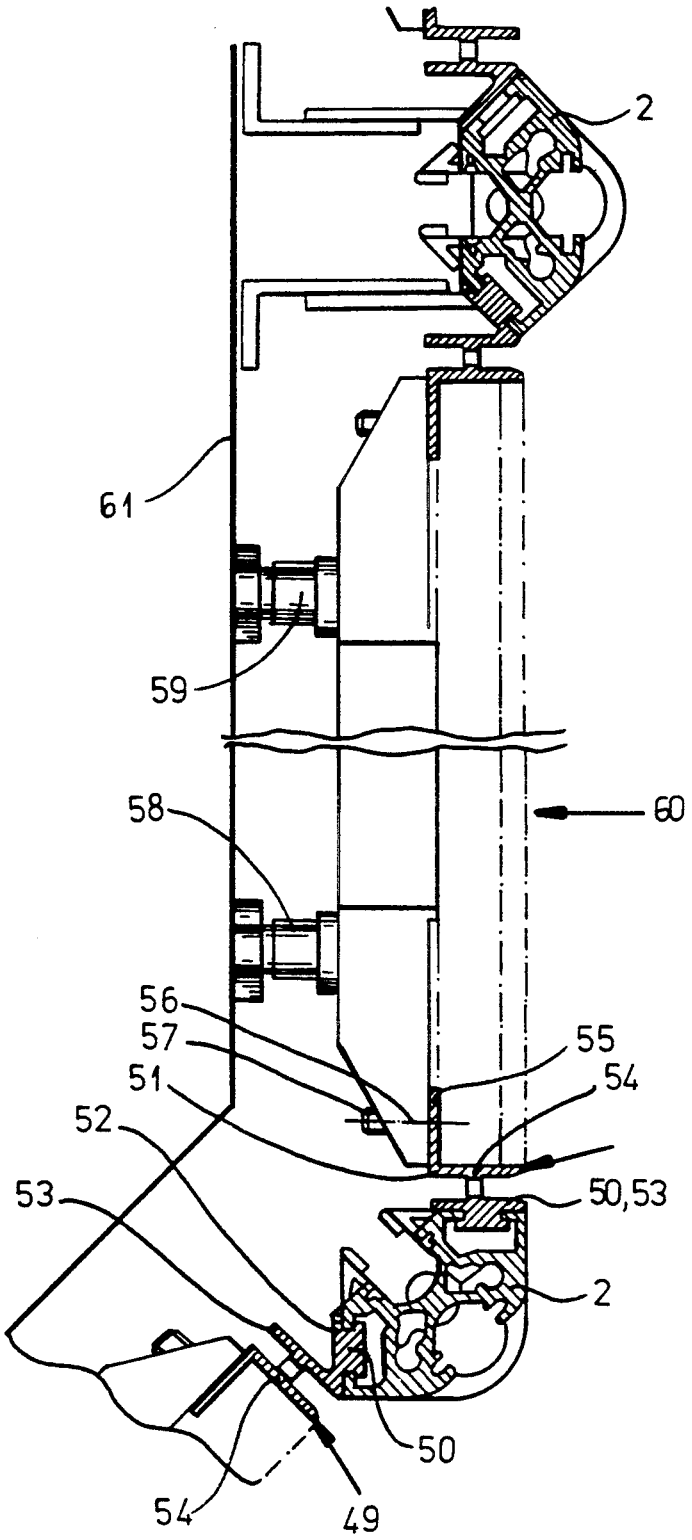
FIG. 4 is a variant on the system of FIG. 3.
Figure 6:
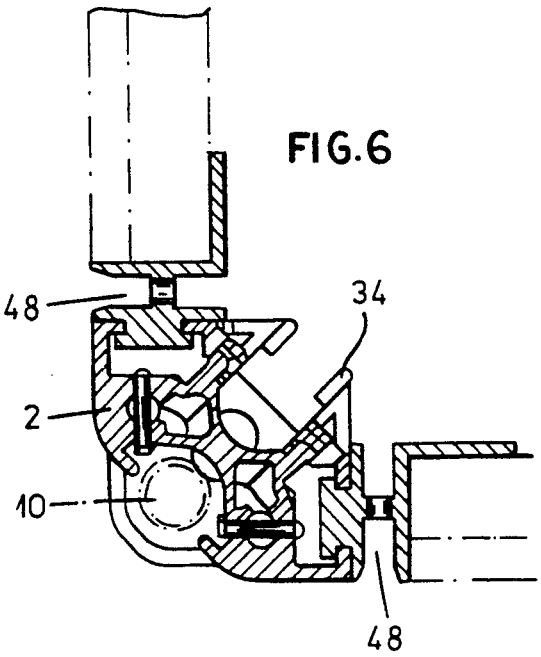
FIG. 6 is a horizontal section through the post rail of FIG. 5.

FIG. 3 shows the arrangement of this invention forming a cladding 46 around a column 47. To this end the rails 2 are provided in their grooves 21 with adaptor brackets 48 of generally H-shape, which brackets 48 are also shown in FIG. 6. FIG. 4 shows another bracket 49 which does not fit around a right angle, but around a much more obtuse angle, but that is functionally identical to the bracket 48. More particularly the bracket 49 has an inner web 50 that is slotted at 52 to fit over the lips defining the edges of the slot 21, an intermediate web 53 extending at about 45° to the web 50, and an outer web 54 from which extends a crosswise flange 55 to which a panel 60 is secured. Spacer bolts 58 and 59 brace the panel 60 against an outer surface 61 of a wall and bolts 57 pass through holes 56 in the flanges 55 to secure the panel 60 in place thereon. In the right-angle bracket 48 both webs 50 and 53 are the same element.

Figure 5:
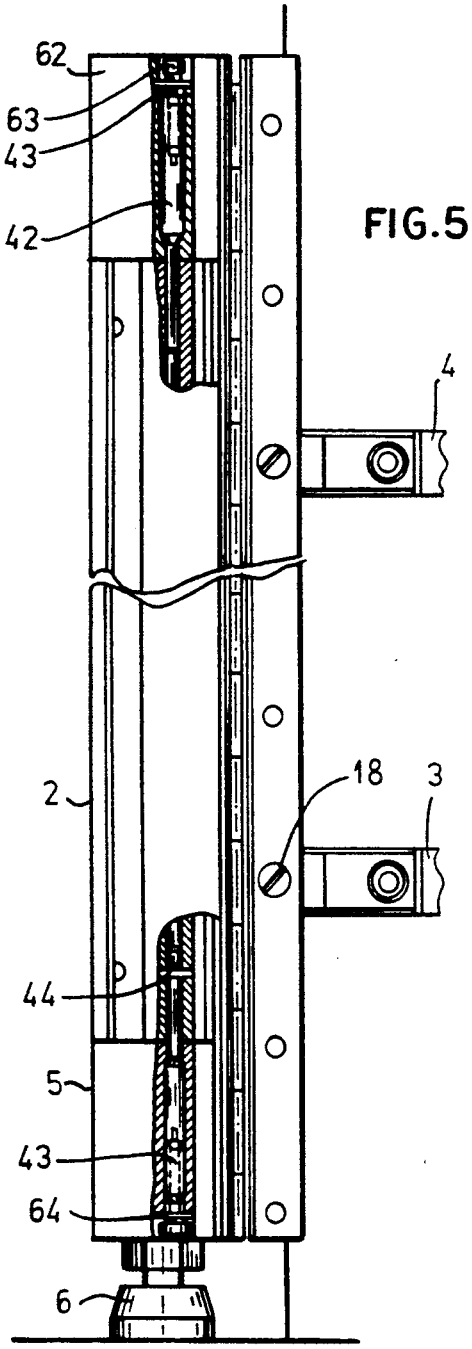
FIG. 5 is a large-scale side view partly in section through a case similar to that of FIG. 1.

FIG. 5 shows how screws 63 and 64 threaded into the top and bottom of sleeve-like bolts 43 are used to lock the upper panel 62 and lower panel 5, respectively, in place. Screws 18 secure the shelves 3 and 4 in place. The top and bottom panels 62 and 5 serve to lock the lenses 12 and 13 in place. Thus to switch a bulb 10, one need only remove the top wall 62, pull out the dead bulb, slide in a new one, and replace the top wall 62. The electrical connections and transformer for the bulbs 10 are provided in the lower wall 5 to facilitate this.

Figure 7:
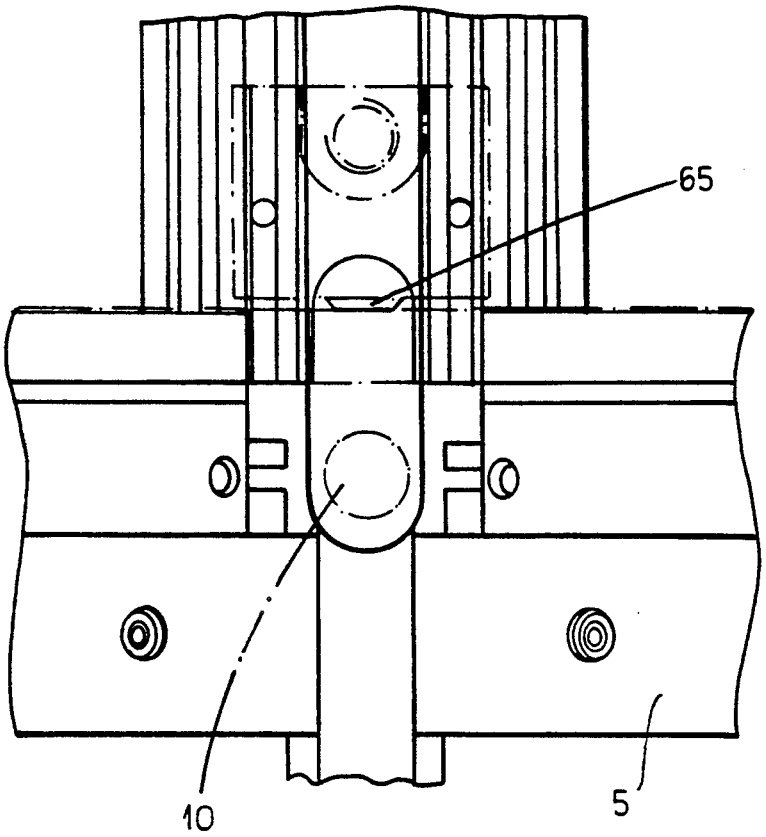
FIGS. 7 and 8 are detail views of the lowermost shelf of the case of FIG. 1 where it joins the post rail.
Figure 8:
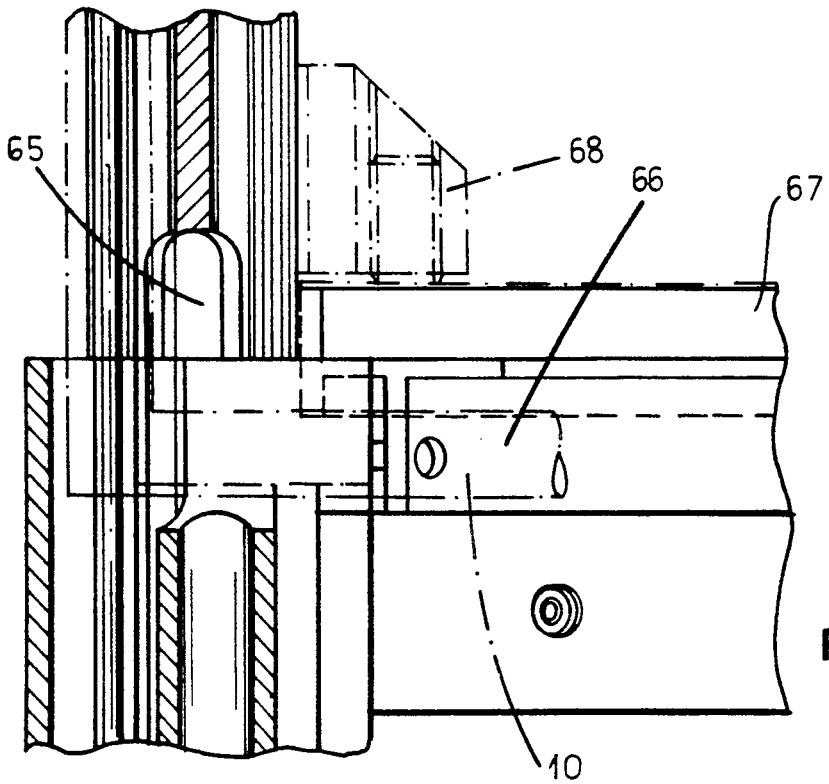

The transition between the rail 2 and the floor shelf 5 is shown in more detail in FIGS. 7 and 8. Electrodes 66 in the shelf 55 are connected to the lamp 10 and are protected by a cover plate 67. The rail 2 is formed with a slot 65 so that the respective bulb !0 can be twisted and removed. Latches 68 are provided to secure the cover plates 67, which may be of colored glass or even mirror, in place.

Figure 9:
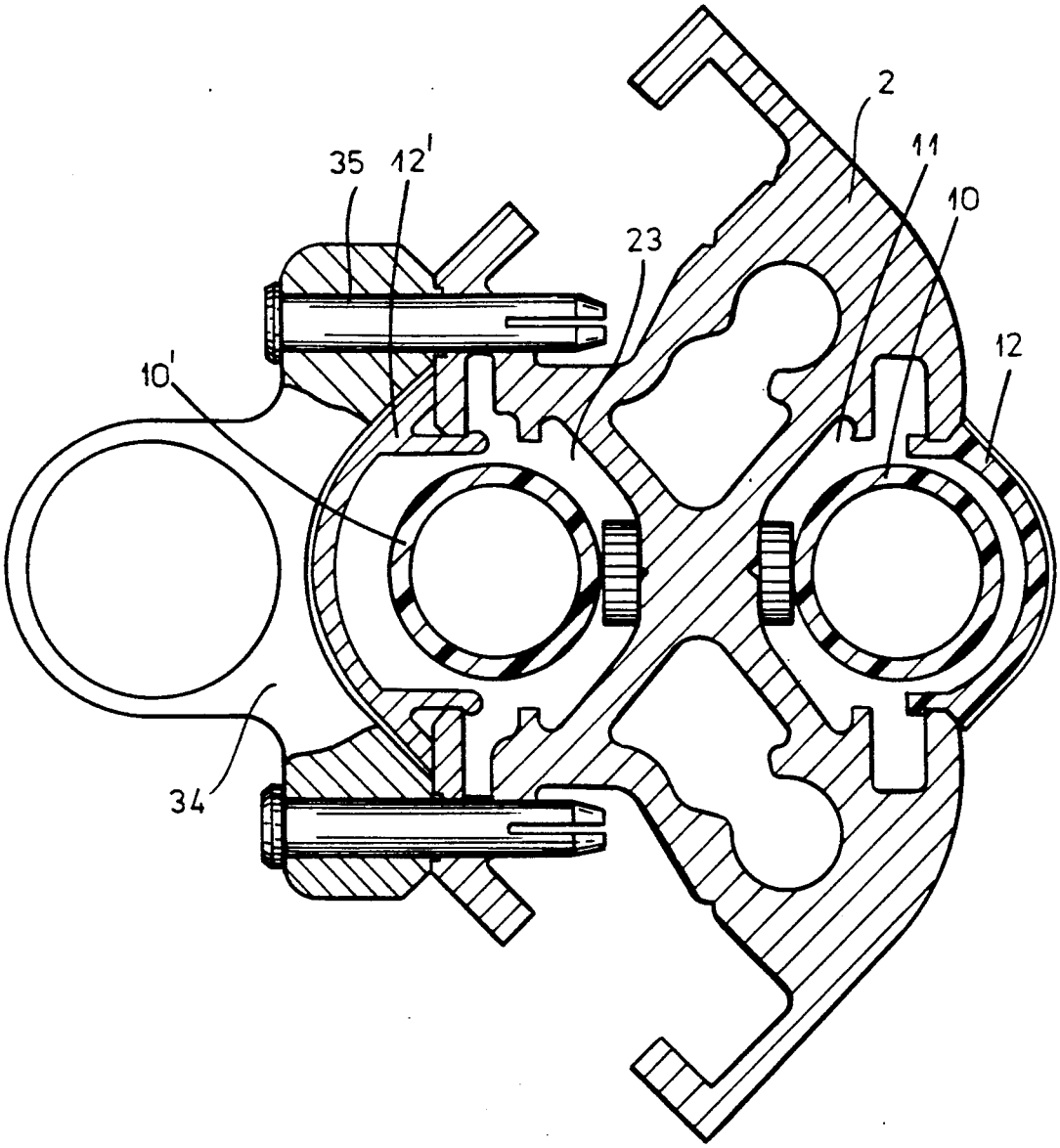
FIGS. 9, 10, and 11 are cross sections through further rails according to the present invention.
Figure 10:
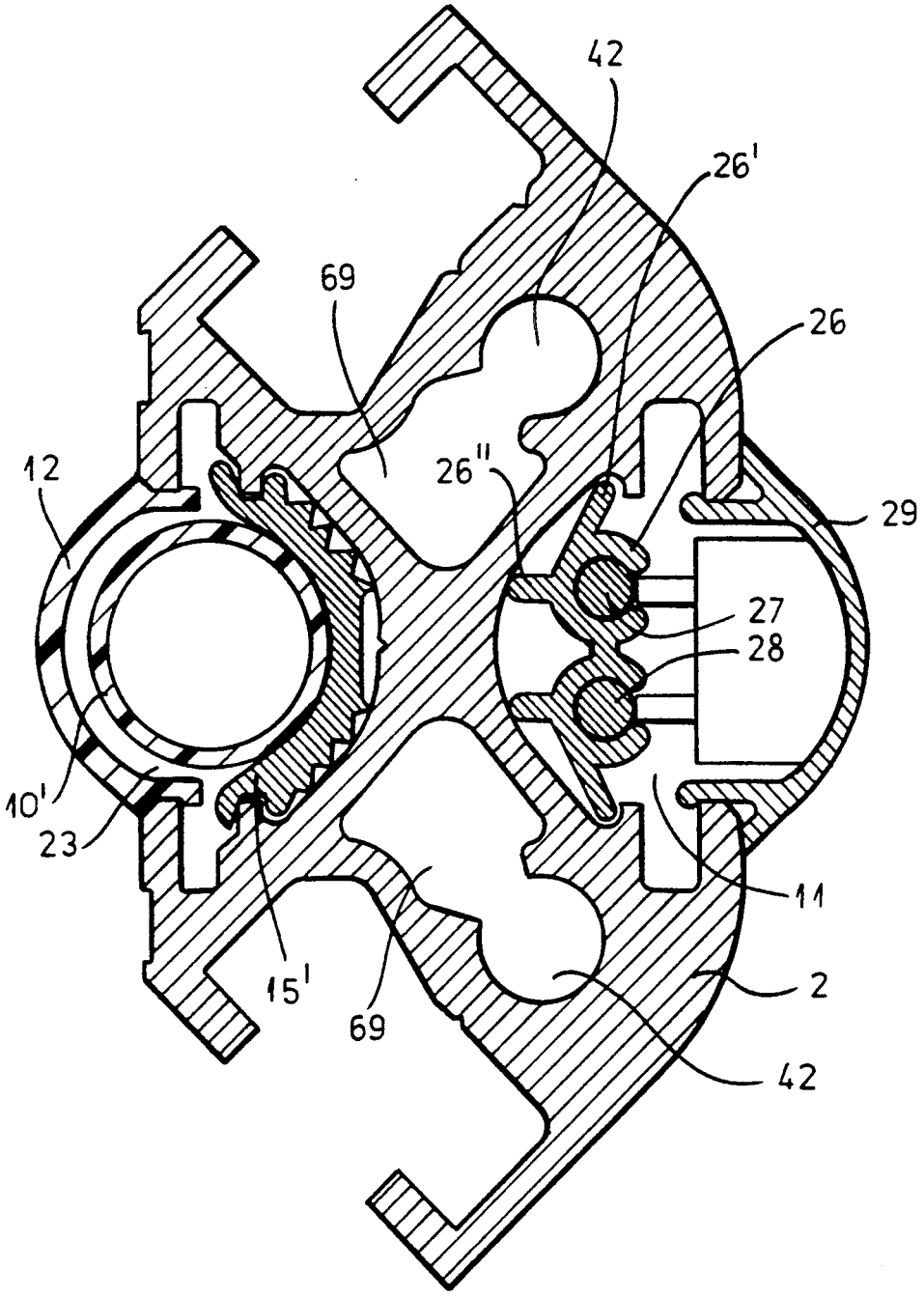

FIGS. 9 and 10 show how an inner lens 12' is used over an inner lamp 10' in the inner groove 23 for strip-like high-lighting of the contents of a display case using the rail 2. In addition in FIG. 10 there is no outer bulb at all, instead the conductors 27 and 28 and the opaque covers 29 are provided over the outer slot 11. Furthermore in FIG. 10 a U-shaped bumper strip 15' is used underneath the lamp 12'. In both figures the rail 2 is formed with longitudinally throughgoing passages 69 opening into the passages 42 and serving for conducting wires the length of the rail 2.

Figure 11:
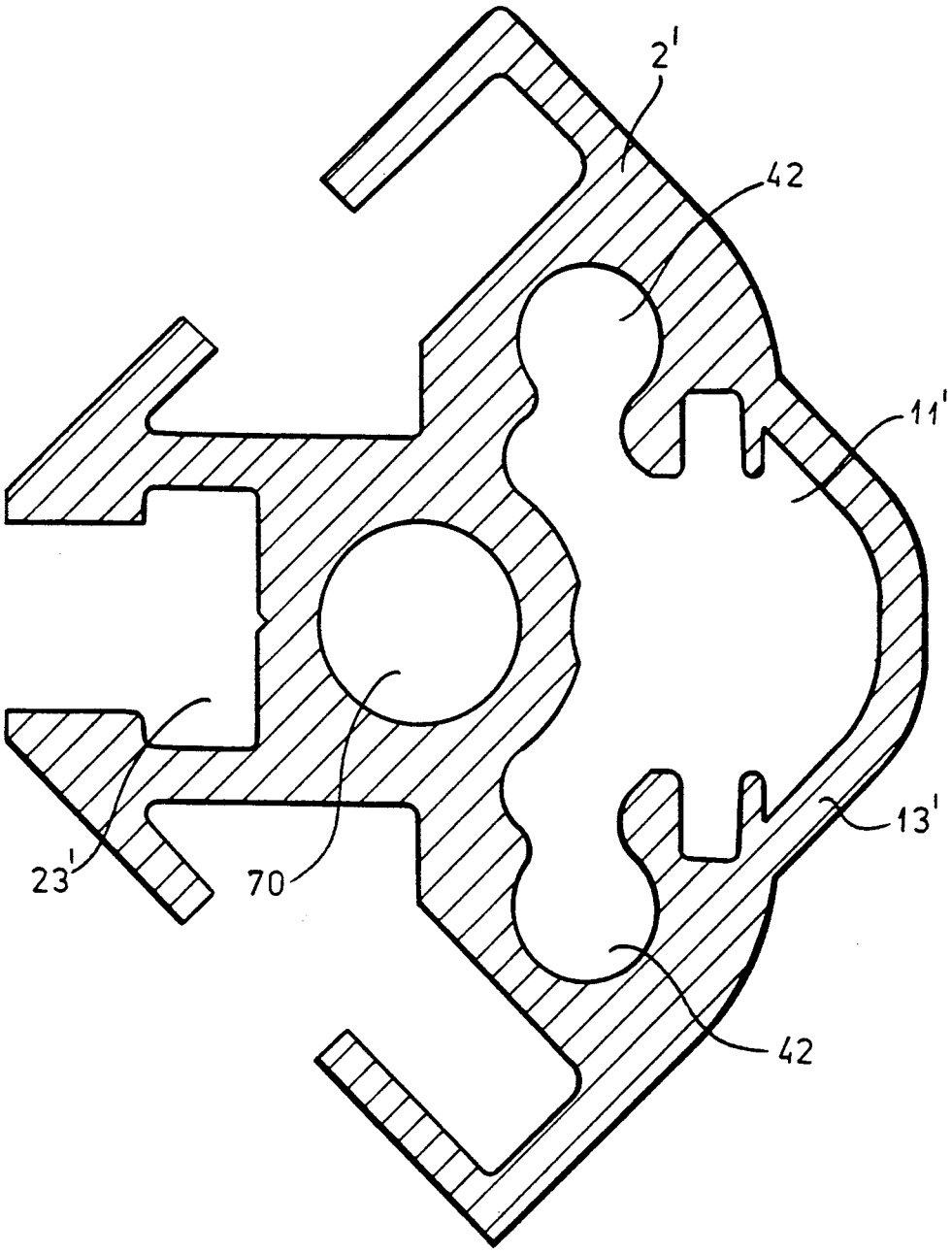

In FIG. 11 the rail 2' in which the outer groove 11' is closed by an integral cover 13' and the rail 2' has a central wire passage 70 and an inner groove 23' adapted for mounting brackets or the like.

I claim:

1. A rack assembly comprising:

a plurality of elongated rails of generally square section having four sides meeting at corners and each formed unitarily with a light groove opening at one of the corners between two adjacent sides, a supply groove opening at the corner between the other two sides diagonally opposite the light groove, and a pair of connecting grooves formed in and opening at the sides flanking one of the light and supply grooves, the connecting grooves opening perpendicular to each other;

at least one electrical conductor exposed generally the full length of and extending along the supply groove;

a tubular lamp in and extending along the light groove;

an accent lamp secured to the rail over the supply groove and connected to the conductor therein; and respective transverse elements fitted to the connecting grooves.

2. The illuminated rack assembly defined in claim 1, further comprising a lens covering the light groove, the transverse elements being shelves including a top shelf and a bottom shelf vertically flanking and holding the lens.

3. The illuminated rack assembly defined in claim 2 wherein the lens is of an at least semitransparent synthetic resin and is snap fitted to the light groove.

4. The illuminated rack assembly defined in claim 1, further comprising a compressible bumper strip in the light groove braced between the tubular lamp and the rail.

5. The illuminated rack assembly defined in claim 1 wherein the accent lamp is provided with mounting bolts engaged in the two other sides of the rail to each side of the supply groove.

6. The illuminated rack assembly defined in claim 1 wherein the rail is formed with lips projecting toward each other and bounding the supply groove, the conductor including a pair of wires and a profiled resilient strip in which the wires are imbedded adjacent each other, the strip being formed with ribs braced outward against the lips to retain the wires in the supply groove.

7. The illuminated rack assembly defined in claim 1 wherein the connecting grooves are formed in the sides flanking the light groove.

8. The illuminated rack assembly defined in claim 1 wherein the connecting grooves are formed in the sides flanking the supply groove.

9. The illuminated rack assembly defined in claim 1 wherein the rail is further formed with at least one longitudinally throughgoing bolt passage, the assembly further comprising a retaining bolt engaged in the passage and holding the transverse elements.

10. The illuminated rack assembly defined in claim 1 wherein the transverse element is a panel and an edge strip engaged in the connecting groove.

11. The illuminated rack assembly defined in claim 10 wherein the edge strip is generally of H-section and has one leg engaged with the respective connecting groove and an opposite leg connected to the panel.

12. The illuminated rack assembly defined in claim 11 wherein the opposite leg has a perpendicular flange to which the panel is bolted.

13. The illuminated rack assembly defined in claim 11 wherein the panel is provided with spacer bolts adapted to engage a surface supporting the assembly.

* * * * *